US010903576B2

(12) United States Patent
Wu et al.

(10) Patent No.: US 10,903,576 B2
(45) Date of Patent: Jan. 26, 2021

(54) ANTENNA ASSEMBLY AND ELECTRONIC APPARATUS

(71) Applicant: GUANGDONG OPPO MOBILE TELECOMMUNICATIONS CORP., LTD., Guangdong (CN)

(72) Inventors: Qing Wu, Dongguan (CN); Haijun Tang, Dongguan (CN); Huanhong Liu, Dongguan (CN); Guolin Liu, Dongguan (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 231 days.

(21) Appl. No.: 16/190,509

(22) Filed: Nov. 14, 2018

(65) Prior Publication Data

US 2019/0207318 A1 Jul. 4, 2019

(30) Foreign Application Priority Data

Dec. 29, 2017 (CN) ..... 2017 1 1499681
Dec. 29, 2017 (CN) ..... 2017 2 1928957 U

(51) Int. Cl.
*H01Q 13/10* (2006.01)
*H01Q 1/24* (2006.01)
(Continued)

(52) U.S. Cl.
CPC ..... *H01Q 13/10* (2013.01); *H01Q 1/243* (2013.01); *H01Q 1/48* (2013.01); *H01Q 9/045* (2013.01);
(Continued)

(58) Field of Classification Search
CPC ..... H01Q 13/10; H01Q 9/26; H01Q 9/42; H01Q 9/045; H01Q 9/0471; H01Q 9/0457; H01Q 9/32; H01Q 1/48; H01Q 1/243
See application file for complete search history.

(56) References Cited

U.S. PATENT DOCUMENTS

2011/0074647 A1 3/2011 Xiong et al.
2015/0009074 A1* 1/2015 Hsieh ..... H01Q 1/521 343/700 MS
(Continued)

FOREIGN PATENT DOCUMENTS

CN 102035070 A 4/2011
CN 102035070 A 4/2011
(Continued)

OTHER PUBLICATIONS

International search report issued in corresponding international application No. PCT/CN2018/106211, dated Dec. 20, 2018.
(Continued)

*Primary Examiner* — Dameon E Levi
*Assistant Examiner* — David E Lotter
(74) *Attorney, Agent, or Firm* — Ladas & Parry, LLP

(57) ABSTRACT

An antenna assembly may include an excitation source configured to generate an excitation signal, an antenna radiator including a first end and an opposing second end, a reference ground disposed corresponding to the antenna radiator, adjacent to the first end and including a first surface adjacent to the first end and an opposing second surface adjacent to the second end, a support body arranged on the second surface of the reference ground and extending along a direction from the first end to the second end, and a conductive sheet arranged on the support body, adjacent and coupled to the second end and configured to transmit the excitation signal from the excitation source to the antenna
(Continued)

radiator, the antenna radiator may be configured to generate an electromagnetic signal according to the excitation signal.

20 Claims, 4 Drawing Sheets

(51) Int. Cl.

| | |
|---|---|
| ***H01Q 9/26*** | (2006.01) |
| ***H01Q 9/42*** | (2006.01) |
| ***H01Q 9/04*** | (2006.01) |
| ***H01Q 9/32*** | (2006.01) |
| ***H01Q 1/48*** | (2006.01) |

(52) U.S. Cl.
CPC ..... *H01Q 9/0457* (2013.01); *H01Q 9/0471* (2013.01); *H01Q 9/26* (2013.01); *H01Q 9/32* (2013.01); *H01Q 9/42* (2013.01)

(56) References Cited

U.S. PATENT DOCUMENTS

| | | | | |
|---|---|---|---|---|
| 2017/0077592 | A1* | 3/2017 | Tsai | H01Q 25/50 |
| 2017/0155186 | A1* | 6/2017 | Lin | H01Q 1/243 |

FOREIGN PATENT DOCUMENTS

| | | | |
|---|---|---|---|
| CN | 104471789 | A | 3/2015 |
| CN | 102956953 | B | 7/2015 |
| CN | 106532275 | A | 3/2017 |
| CN | 106532275 | A | 3/2017 |
| CN | 106887695 | A | 6/2017 |
| CN | 108232425 | A | 6/2018 |
| CN | 108235620 | A | 6/2018 |
| EP | 1403964 | A1 | 3/2004 |
| EP | 2421093 | A1 | 2/2012 |
| EP | 3057176 | A1 | 8/2016 |

OTHER PUBLICATIONS

Written opinion of the international searching authority issued in corresponding international application No. PCT/CN2018/106211, dated Dec. 20, 2018.
First Office Action from China patent office in a counterpart Chinese patent Application 201711499681.0, dated Jul. 29, 2019 (10 pages).
Extended European search report, Application EP18197534, dated Apr. 2, 2019(9 pages).
Indian First Examination Report, Indian Application No. 201814040281, dated Aug. 19, 2020 (6 pages).

* cited by examiner

ANTENNA ASSEMBLY AND ELECTRONIC APPARATUS

CROSS REFERENCE TO RELATED APPLICATIONS

This application claims priorities to Chinese Patent Application No. 201711499681.0, filed on Dec. 29, 2017, and Chinese Patent Application No. 201721928957.8, filed on Dec. 29, 2017, the contents of which are herein incorporated by reference in their entireties.

TECHNICAL FIELD

The described embodiments relate to electronic products, and in particular to an antenna assembly and an electronic apparatus with the antenna assembly.

BACKGROUND

Since a metal shell could make the electronic device more wear-resistant, using metal material to make the shell (battery cover) of electronic device may be a mainstream. When an electronic device communicates with other electronic devices, antennas are often required to radiate the electromagnetic signals and receive the electromagnetic signals come from other electronic devices. At present, the commonly used antennas are Planar Inverted-F Antenna (PIFA) and Inverted-F Antenna (IFA). However, when these antennas are applied to an electronic device with a metal shell, these antennas are unable to receive and radiate electromagnetic signals because of the shielding effect of metal shells. Therefore, the metal shell is often provided with a slot for antenna to radiate electromagnetic signals and receive electromagnetic signals. However, the frequency band of the electromagnetic signals radiated by antennas in traditional electronic devices is less, resulting in a narrower bandwidth of the mobile terminal.

BRIEF DESCRIPTION OF THE DRAWINGS

In order to make the technical solution described in the embodiments of the present disclosure more clear, the drawings used for the description of the embodiments will be briefly described. Apparently, the drawings described below are only for illustration but not for limitation. It should be understood that, one skilled in the art may acquire other drawings based on these drawings, without making any inventive work.

DETAILED DESCRIPTION

Figure 1:
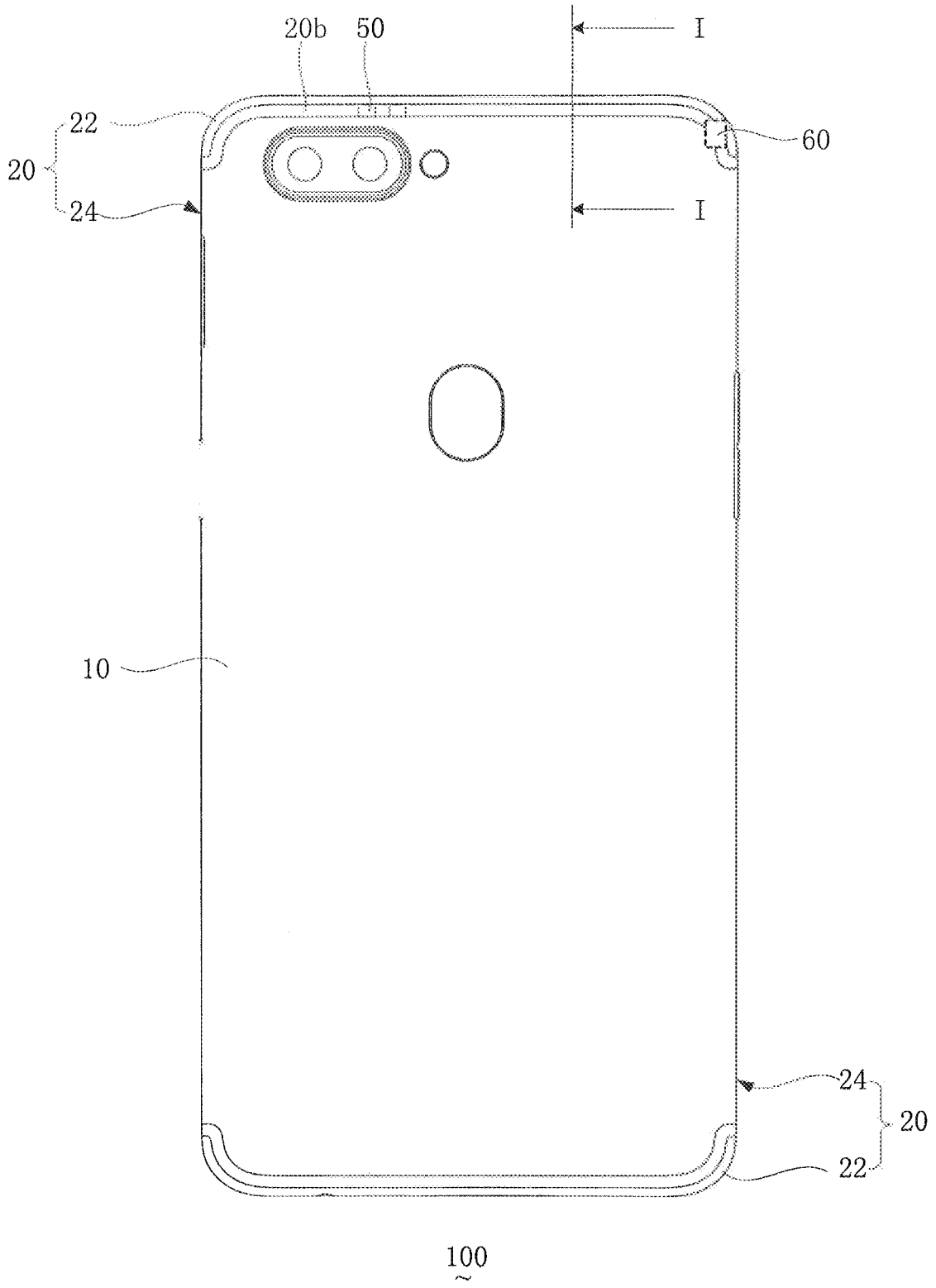
FIG. 1 is an isometric view of an electronic apparatus according to an embodiment of the present disclosure.

In order to more clearly understand the objective, the features and advantages of the present disclosure, the present disclosure will be described in details with reference to the drawings and the embodiments. It should be noted that, the embodiments and the features recited in the embodiments of the present disclosure may be combined with each other without confliction.

Plenty of specific details are described in the embodiments in order to better understand the technical solution of the present disclosure. However, the embodiments embodiments described in the present disclosure, one skilled in the art may acquire all other embodiments without any creative work. All these shall be covered within the protection scope of the present disclosure.

In the embodiments of the present disclosure, it is to be understood that terms such as "central", "longitudinal", "lateral", "length", "width", "thickness", "upper", "lower", "front", "rear", "left", "right", "vertical", "horizontal", "top", "bottom", "inner", "outer", "clockwise" and "counterclockwise" refer to the orientations and locational relations illustrated in the drawings, and for describing the present disclosure and for describing in a simple manner, and which are not intended to indicate or imply that the device or the elements are disposed to locate at the specific directions or are structured and performed in the specific directions, which could not to be understood as limiting the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of such a feature. In the description of the present disclosure, "a plurality of" means two or more than two, unless specified otherwise.

In the embodiments of the present disclosure, unless specified or limited otherwise, terms "mounted", "connected," "coupled", "fixed" and the like are used in a broad sense, and may include, for example, fixed connections, detachable connections, or integral connections; may also be mechanical or electrical connections; may also be direct connections or indirect connections via intervening structures; may also be inner communications of two elements, as can be understood by those skilled in the art depending on specific contexts.

In the embodiments of the present disclosure, unless specified or limited otherwise, a structure in which a first feature is "on" or "below" a second feature may encompass an embodiment in which the first feature is in a direct contact with the second feature, and may also encompass an embodiment in which the first feature and the second feature are not in a direct contact, but are contacted via an additional feature provided therebetween. Furthermore, expressions such as a first feature is "on", "above" or "on top of" a second feature may encompass an embodiment in which the first feature is right or obliquely "on", "above" or "on top of" the second feature, or just that the first feature is at a height higher than that of the second feature; while expressions such as a first feature is "below", "under" or "on bottom of" a second feature may encompass an embodiment in which the first feature is right or obliquely "below", "under" or "on bottom of" the second feature, or just that the first feature is at a height lower than that of the second feature.

The following disclosure provides many different embodiments or examples for implementing different structures of the embodiments of the present disclosure. In order to simplify the disclosure of embodiments, the components and settings of the specific examples are described below. Of course, they are merely examples and are not intended to limit the present disclosure. In addition, the embodiments of the present disclosure may repeat reference numerals and/or reference letters in different examples, which are for the purpose of simplicity and clarity, and do not in themselves indicate the relationship between the various embodiments and/or arrangements discussed. Moreover, embodiments of the present disclosure provide examples of various specific processes and materials, but one of ordinary skill in the art will recognize the use of other processes and/or the use of other materials.

References throughout this specification to "an embodiment", "some embodiments", "one embodiment", "another example", "an example", "a specific example" or "some examples" mean that a particular feature, structure, material, or characteristic described in connection with the embodiment or example is included in at least one embodiment or example of the present disclosure. Thus, the appearances of the phrases such as "in some embodiments", "in one embodiment", "in an embodiment", "in another example", "in an example", "in a specific example" or "in some examples" in various places throughout the specification are not necessarily referring to the same embodiment or example of the present disclosure. Furthermore, the particular features, structures, materials, or characteristics may be combined in any suitable manner in one or more embodiments or examples.

In the following, an electronic apparatus 100 provided in embodiments of the present disclosure will be described with reference to drawings.

The electronic apparatus 100 may include intelligent devices such as smartphone, mobile internet device (MID), Ebook, Play Station Portable (PSP), Personal Digital Assistant (PDA) and the like. It should be understood that "electronic apparatus 100" in the present disclosure may include, but be not limited to an apparatus receiving/transmitting communication signals via wired connection, for example, public switched telephone network (PSTN), digital subscriber line (DSL), digital cable, electric cable and/or another data connection/network, and/or cellular network, Wireless Area Networks (WLAN), digital television network such as DVB-H (Digital Video Broadcasting Handheld) network, satellite network, AM-FM broadcast transmitter and/or another communication terminal of wireless interface. The electronic apparatus 100 may also include a satellite or cellular telephone, a personal communication system terminal with cellular radio telephone and data processing, facsimile and data communication, beeper, or other electronic apparatuses with a transceiver.

Figure 2:
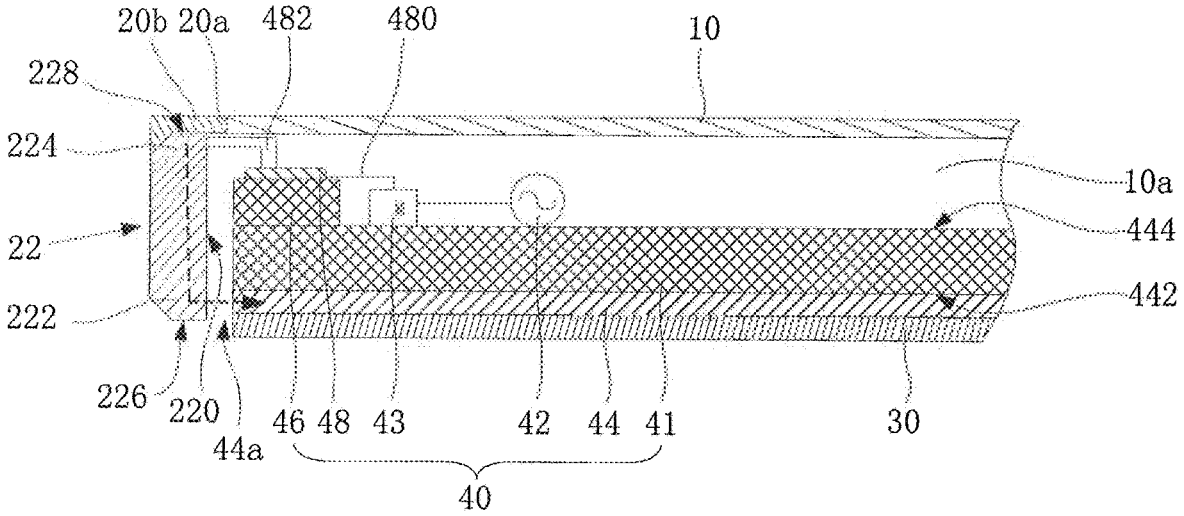
FIG. 2 is a cross-sectional view of the electronic apparatus taken along a line I-I according to an embodiment of the present disclosure.

Referring to FIGS. 1 and 2, the electronic apparatus 100, according to an exemplary embodiment, may include a back shell 10, a front shell 20 connected to and surrounding the back shell 10, a screen 30 embedded in the front shell 20, and an antenna assembly 40. The back shell 10 and the front shell 20 may define a chamber 10*a*, the antenna assembly 40 may be arranged in the chamber 10*a* and covered by the screen 30.

The back shell 10, which may be called as a back cover, may have a rectangular configuration in some embodiments of the present disclosure. In other embodiments, the back shell 14 may have other configurations, such as round, long round and ellipse etc.

The front shell 20, which may sometimes be referred to as a middle frame, may be formed of metal (e.g., stainless steel, aluminum, etc.) or other conductive materials. At least part of the front shell 20 may be configured to be an antenna radiator 22 of the antenna assembly 40 to generate electromagnetic signal according to an excitation signal. The configuration of the front shell 20 may be consistent with the back shell 10. In some embodiments, the front shell 20 may also have a rectangular configuration and include two first portions and two second portion 24 connected between the two first portions. The two first portions may be opposite to each other and configured to be the antenna radiators 22. The two second portions 24 may be arranged opposite to each other.

In some embodiments, the antenna radiator 22 may include a first end 222, an opposing second end 224, a first end face 226 away from the second end 224, a second end face 228 away from the first end 222, and a side surface 220 connected between the first end face 226 and the second end face 228. A direction from the first end 222 to the second end 224 of the antenna radiator 22 may be substantially perpendicular to the back shell 10. The second end 224 may be adjacent to the back shell 10.

In some embodiments, the antenna radiator 22 and the back shell 10 may define a slot 20*a* therebetween. A sealing material may be filled in the slot 20*a* to form a sealing layer 20*b* to connect the antenna radiator 22 and the back shell 10 together. The sealing layer 20*b* may be an insulating layer which may not have a shielding effect on the electromagnetic signals, such that the electromagnetic signal could pass through the sealing layer 20*b* and be radiated outside. In some embodiments, the slot 20*a* may be a U-shaped slot (shown in FIG. 1), in other embodiments, the slot may be a straight-line slot or other shapes.

In other embodiments, a first conductive connector 50 stretching across the slot 20*a* may be provided. The antenna radiator 22 may be electrically connected to the back shell 10 by the first conductive connector 50. In some embodiments, the first conductive connector 50 may be welded to the antenna radiator 22 and the back shell 10. In other embodiments, the first conductive connector 50 may be connected to the antenna radiator 22 and the back shell 10 by screw or the like, which is not limited herein.

In still other embodiments, a second conductive connector 60 may be arranged on the antenna radiator 22 and corresponding to the back shell 10, such that a capacitive coupling may be formed between the second conductive connector 60 and the back shell 10. Specifically, the second conductive connector 60 may be arranged on an end of the antenna radiator 22 adjacent to one of the second portions 24.

The screen 30, according to an exemplary embodiment, may be substantially parallel to the back shell 10. The screen 30 may include pixels formed from light-emitting diodes (LEDs), organic LEDs (OLEDs), plasma cells, electrowetting pixels, electrophoretic pixels, liquid crystal display (LCD) components, or other suitable pixel structures. A screen cover layer such as a layer of clear glass or plastic may cover the surface of the screen 30 or the outermost layer of the screen 30 may be formed from a color filter layer, thin-film transistor layer, or other display layer. In this embodiment, the screen 30 may further incorporate touch electrodes and be used as a touch screen for inputting information.

Figure 3:
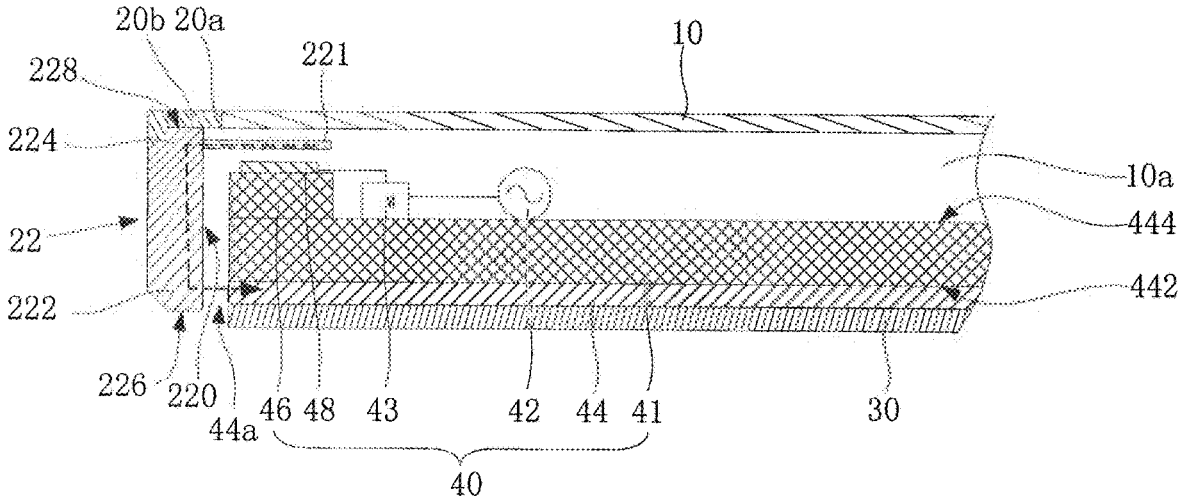
FIG. 3 is a cross-sectional view of the electronic apparatus taken along a line I-I according to another embodiment of the present disclosure.
Figure 4:
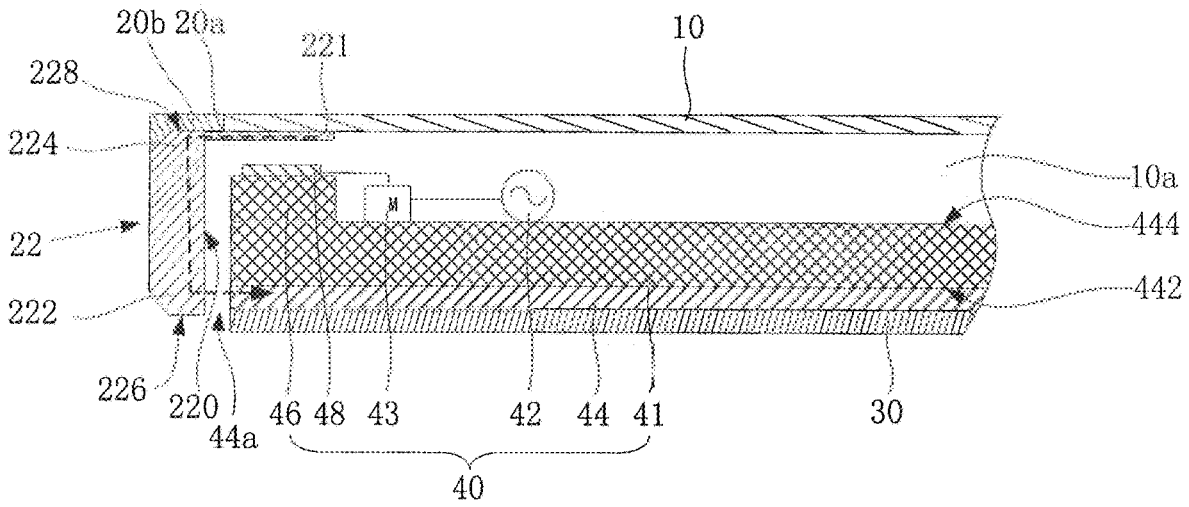
FIG. 4 is a cross-sectional view of the electronic apparatus taken along a line I-I according to still another embodiment of the present disclosure.
Figure 5:
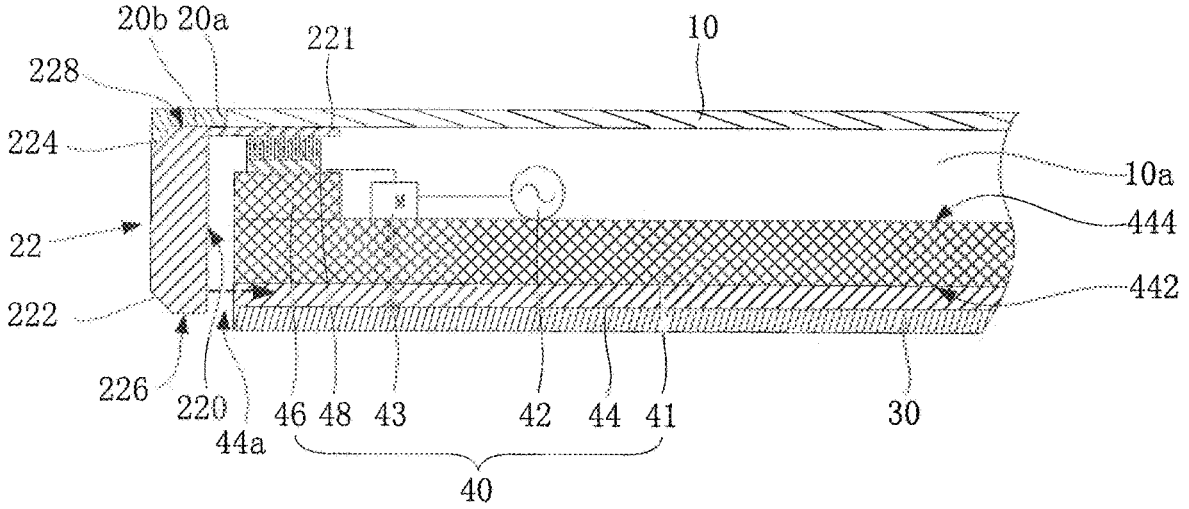
FIG. 5 is a cross-sectional view of the electronic apparatus taken along a line I-I according to yet another embodiment of the present disclosure.

Referring to FIGS. 3 to 5 and combining with FIG. 2, the antenna assembly 40 may include an excitation source 42 configured to generate an excitation signal, a reference ground 44 disposed corresponding to the antenna radiator 22, substantially parallel to the back shell 10 and adjacent to the first end 222, a circuit board 41 stacked on the reference ground 44, a support body 46 arranged on the circuit board 41, a conductive sheet 48 arranged on the support body 46 and coupled to the second end 224 of the antenna radiator 22 and the excitation source 42, so as to transmit the excitation signal from the excitation source 42 to the second end 224 of the antenna radiator 22, and an impedance matching circuit 43 connected to the excitation source 42 and the antenna radiator 22.

In some embodiments, as shown along the dotted line in FIGS. 2 to 5, the excitation signal from the excitation source 42 may be sequentially transmitted to the impedance matching circuit 43, the conductive sheet 48, the second end of the antenna radiator 22, the first end of the antenna radiator 22, and the reference ground 44. When the excitation signal is transmitted in the antenna radiator 22, the antenna radiator 22 may generate the electromagnetic signal according to the excitation signal. The electromagnetic signal may be radiated out of the electronic apparatus 100 through the sealing layer 20*b* in the slot 20*a*.

The reference ground 44 may be arranged adjacent to the first end 222 and the side surface 220 of the antenna radiator 22. The reference ground 44 and the antenna radiator 22 may define a gap 44*a* configured to be at least part of a clearance zone. In some embodiments, the reference ground 44 may include a first surface 442 adjacent to the first end 222 and an opposing second surface 444 adjacent to the second end 224.

In some embodiments, the reference ground 44 may be a metal plate. At least part of the reference ground 44 may face the side surface 220 of the antenna radiator 22. In other embodiments, the first surface 442 may be flush with the first end face 226 of the antenna radiator 22.

In some embodiments, the reference ground 44 may further configured to support the screen 30. The screen 30 may be attached on the reference ground 44.

The circuit board 41 may be a flexible circuit board, a printed circuit board or other circuit boards, which is not limited herein. The circuit board 41 may be stacked on the second surface 444 of the reference ground 44.

The support body 46 may extend along a direction from the first end 222 to the second end 224 and configured to support the conductive sheet 48. In some embodiments, the support body 46 and the circuit board 41 may be two different components. The support body 46 may be fixed on an end of the circuit board 41 adjacent to the antenna radiator 22.

In other embodiments, the support body 46 may be a part of the circuit board 41, and extend from an end of the circuit board 41 adjacent to the antenna radiator 22.

The conductive sheet 48 may be arranged on a surface of the support body 46 away from the reference ground 44 such that the conductive sheet 48 may be adjacent to the second end 224 of the antenna radiator 22. In some embodiments, the conductive sheet 48 may be a part of the circuit board 41, and formed of a single piece with the circuit board 41. Since the conductive sheet 48 is supported by the support body 46, the distance between the conductive sheet 48 and the reference ground 44 may be farther, which could prevent the energy of the excitation signal from coupling to the reference ground 44. Therefore more energy of the excitation signal may be radiated to form the electromagnetic signal. As a result, radiation efficiency of the antenna 22 could be improved. Furthermore, since the conductive sheet 48 may be connected to the second end 224 of the antenna radiator 22, the excitation signal may be transmitted from the second end 224 to the first end 222 of the antenna radiator 22, the transmission path of the excitation signal may be extended. Therefore, the excitation signal may be transmitted more evenly, and the bandwidth of electromagnetic signal may be widened.

Furthermore, when the first surface 442 of the reference ground 44 is flush with the first end 222 of the antenna radiator 22, the distance between the conductive sheet 48 and the reference ground 44 may further be extended. Therefore, more energy of the excitation signal may be radiated to form the electromagnetic signal, rather than being coupled to the reference ground 44. In addition, the transmission path of the excitation signal may further be extended, and thus the excitation signal may be transmitted more evenly, thereby widening the bandwidth of electromagnetic signal.

In some embodiments, the conductive sheet 48 may be connected to the second end 224 of the antenna radiator 22 in a way of direct feeding. In particularly, the conductive sheet 48 may be electrically connected to the impedance matching circuit 43 directly by a conductor, such as, a wire, a metal sheet or the like, to receive the excitation signal from the excitation source 42. The conductive sheet 48 may be electrically connected to the second end 224 of the antenna radiator 22 directly by a conductor, such as, a wire, a metal sheet or the like, so as to transmit the excitation signal to the second end 224 of the antenna radiator 22. For example, an end of the conductive sheet 48 may be electrically connected to the impedance matching circuit 43 by a wire 480. The other end of the conductive sheet 48 may be electrically connected to the second end 224 of the antenna radiator 22 by the metal sheet 482 (as shown in FIG. 2). In some embodiments, both the connection between the conductive sheet 48 and the antenna radiator 22, and the connection between the conductive sheet 48 and the impedance matching circuit 43 may be achieved by the wire 480, or the metal sheet 482.

In other embodiments, the conductive sheet 48 may be electrically connected to the second end 224 of the antenna radiator 22 in a way of coupling feeding. In particularly, the antenna radiator 22 may further include an extending portion 221 extending from the second end 224 along a direction substantially perpendicular to the direction from the first end 222 to the second end 224, such that a coupling capacitor may be formed between the extending portion 221 and the conductive sheet 48 (as shown in FIG. 3). As a result, the excitation signal may be transmitted to the antenna radiator 22 in a way of coupling feeding. Furthermore, the structural strength of the antenna radiator 22 could be improved.

In further other embodiments, a surface of the extending portion 221 away from the conductive sheet 48 may be flush with the second end face 228 of the antenna radiator 22 (as shown in FIG. 4). Therefore, the excitation signal could be transmitted to the second end 224 of the antenna radiator 22, which could further extend the transmission path of the excitation signal.

Figure 6:
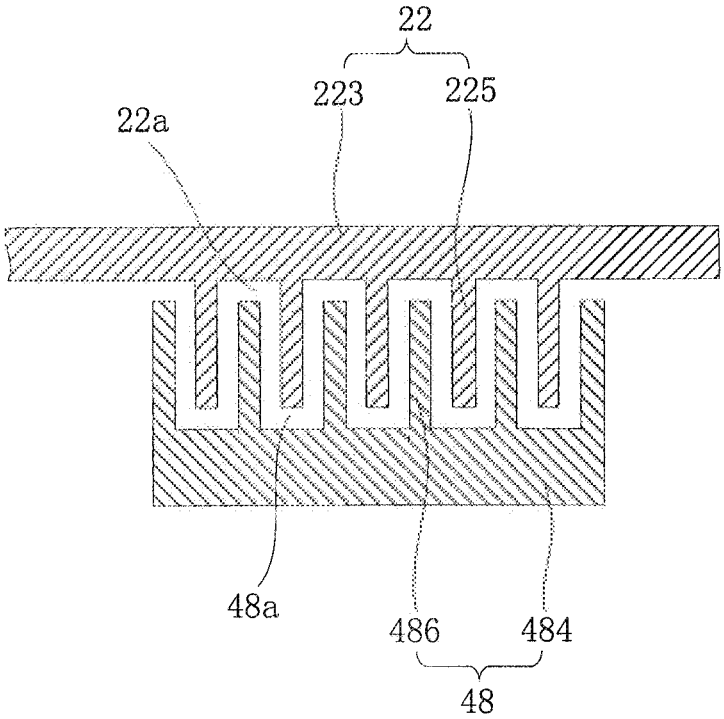
FIG. 6 is an isometric view of the extending portion and the conductive sheet in FIG. 5.

Referring to FIGS. 5 to 6, the extending portion 221 may include a first main body 223 and a plurality of first branches 225 extending from a surface of the first main body 223 toward the conductive sheet 48. The plurality of first branches 225 may be spaced apart from each other. A first accommodating groove 22*a* may be defined by each two adjacent first branches 225. The conductive sheet 48 may include a second main body 484 and a plurality of second branches 486 extending from a surface of the second main body 484 toward the extending portion 221, the plurality of second branches 486 may be spaced apart from each other. A second accommodating groove 48*a* may be defined by each two adjacent second branches 486. At least part of each of the plurality of first branches 225 may be inserted into the second accommodating groove 48*a* between two adjacent second branches 486, meanwhile, at least part of each of the plurality of second branches 486 may be inserted into the first accommodating groove 22*a* between two adjacent first branches 225. As a result, the coupling capacitance between the conductive sheet 500 and the extending portion 221 may be enhanced, thereby improving the quality of signal transmission of the excitation signal from the conductive sheet 500 to the extending portion 221.

In some embodiments, the excitation source 42 may be arranged on a surface of the circuit board 41 away from the reference ground 44. An end of the impedance matching circuit 43 may be connected to the excitation source 42, the other end of the impedance matching circuit 43 may be connected to the conductive sheet 48. The impedance matching circuit 43 may be configured to adjust an output impedance of the excitation source 42, and further configured to adjust an input impedance of the antenna radiator 22, so as to match an output impedance of the excitation source 42 and an input impedance of the antenna radiator 22. Therefore, the output impedance of the excitation source 42 may be matching with the input impedance of the antenna radiator 22, thereby reducing energy loss of the excitation signal in the antenna radiator 22. As a result, the transmission quality of the excitation signal may be improved, and the communication quality of the electronic apparatus 100 with the antenna assembly 40 may be improved.

According to a first aspect of the present disclosure, an antenna assembly may be provided. The antenna assembly may include an excitation source configured to generate an excitation signal, an antenna radiator including a first end and an opposing second end, a reference ground disposed corresponding to the antenna radiator and adjacent to the first end and including a first surface adjacent to the first end and an opposing second surface adjacent to the second end, a support body arranged on the second surface of the reference ground and extending along a direction from the first end to the second end and a conductive sheet coupled to the second end of the antenna radiator and the excitation source and configured to transmit the excitation signal from the excitation source to the antenna radiator. The antenna radiator may be configured to generate an electromagnetic signal according to the excitation signal. The reference ground and the antenna radiator may define a gap configured to be at least part of a clearance zone. The conductive sheet may be arranged on the support body such that the conductive sheet may be adjacent to the second end of the antenna radiator.

In some embodiments, the antenna assembly may further include a circuit board stacked on the second surface of the reference ground. The support body may extend from an end of the circuit board adjacent to the antenna radiator.

In other embodiments, the excitation source may be arranged on a surface of the circuit board away from the reference ground, the conductive sheet may be arranged on a surface of the support body away from the reference ground.

In still other embodiments, the conductive sheet may be electrically connected to the second end of the antenna radiator in a way of direct feeding.

In further other embodiments, the conductive sheet may be electrically connected to the second end of the antenna radiator in a way of coupling feeding.

In some embodiments, the antenna radiator may include an extending portion extending from the second end of the antenna radiator along a direction substantially perpendicular to the direction from the first end to the second end, such that a coupling capacitor may be formed between the extending portion and the conductive sheet.

In other embodiments, the extending portion may include a first main body and a plurality of first branches extending from a surface of the first main body toward the conductive sheet, the plurality of the first branches may be spaced apart from each other. The conductive sheet may include a second main body and a plurality of second branches extending from a surface of the second main body toward the extending portion. The plurality of second branches may be spaced apart from each other. At least part of each of the plurality of first branches may be inserted between two adjacent second branches.

In still other embodiments, the antenna radiator may further include a first end face away from the second end, and a second end face away from the first end, a surface of the extending portion away from the conductive sheet may be flush with the second end face of the antenna radiator.

In further other embodiments, the antenna radiator may further include a side surface connecting the first end face and the second end face, at least part of the reference ground may face the side surface of the antenna radiator.

In some embodiments, the first surface of the reference ground may be flush with the first end face of the antenna radiator.

In other embodiments, the antenna assembly may further include an impedance matching circuit connected to the excitation source and the antenna radiator, and configured to adjust a matching degree between an output impedance of the excitation source and an input impedance of the antenna radiator.

According to a second aspect of the present disclosure, an antenna assembly may be provided. The antenna assembly may include an excitation source configured to generate an excitation signal, an antenna radiator including a first end and an opposing second end, a reference ground disposed corresponding to the antenna radiator and adjacent to the first end and including a first surface adjacent to the first end and an opposing second surface adjacent to the second end, a support body arranged on the second surface of the reference ground and extending along a direction from the first end to the second end and a conductive sheet arranged on the support body such that the conductive sheet is adjacent to the second end of the antenna radiator. The antenna radiator may be configured to generate an electromagnetic signal according to the excitation signal. The excitation signal from the excitation source may be sequentially transmitted to the conductive sheet, the second end of the antenna radiator, the first end of the antenna radiator and the reference ground.

In some embodiments, the antenna radiator may further include a first end face away from the second end, a second end face away from the first end, and a side surface connecting the first end face and the second end face, the first surface of the reference ground may be flush with the first end face of the antenna radiator.

In other embodiments, the conductive sheet may be electrically connected to the second end of the antenna radiator in a way of direct feeding.

In still other embodiments, the conductive sheet may be electrically connected to the second end of the antenna radiator in a way of coupling feeding. The antenna radiator may include an extending portion extending from the second end of the antenna radiator along a direction substantially perpendicular to the direction from the first end to the second end, such that a coupling capacitor may be formed between the extending portion and the conductive sheet.

According to a third aspect of the present disclosure, an electronic apparatus may be provided. The electronic apparatus may include a back shell, a front shell, a screen and an antenna assembly. The front shell may be connected to the back shell and including an antenna radiator configured to generate electromagnetic signal according to an excitation signal and including a first end away from the back shell and a second end adjacent to the back shell. The screen may be embedded in the front shell. The front shell, the back shell and the screen may define a chamber. The antenna assembly may be arranged in the chamber and include an excitation source, a reference ground, a support body, and a conductive sheet. The excitation source may be configured to generate the excitation signal. The reference ground may be disposed corresponding to the antenna radiator and adjacent to the first end. The reference ground may include a first surface adjacent to the first end and an opposing second surface adjacent to the second end. The reference ground and the antenna radiator may define a gap configured to be at least part of a clearance zone. The support body may be arranged on the second surface of the reference ground and extending along a direction from the first end to the second end. The conductive sheet may be arranged on the support body, coupled to the second end of the antenna radiator and the excitation source and configured to transmit the excitation signal from the excitation source to the antenna radiator.

In some embodiments, a slot may be defined between the antenna radiator and the back shell. A sealing layer may be disposed in the slot to connect the antenna radiator and the back shell.

In other embodiments, the slot may be a straight-line slot or a U-shaped slot.

In still other embodiments, the electronic apparatus may include a conductive connector stretching across the slot and connecting the antenna radiator and the back shell.

In further embodiments, the electronic apparatus may further include a conductive connector arranged on the antenna radiator and corresponding to the back shell, such that a capacitive coupling may be formed between the second conductive connector and the back shell.

For one skilled in the art, it is clear that the present application is not limited to the details of the above exemplary embodiments, and that the present application can be implemented in other specific forms without deviating from the spirit or basic characteristics of the application. Therefore, at any point, the embodiments should be regarded as exemplary and unrestrictive, and the scope of the present application is defined by the appended claims, rather than the above description. Therefore, all changes within the meaning and scope of the equivalent elements of the claim is intended to be included. Any appended label recited in the claims shall not be regarded as a limitation to the claims. In addition, apparently, the terms "include", "comprise" and the like do not exclude other units or steps, and the singular does not exclude plural.

It should be noted that, the foregoing disclosed is merely exemplary implementations and it is not intended to limit the scope of the present disclosure. Although the present disclosure is described in details with reference to the above embodiments, however, one skilled in the art may make any modification or equivalence based on the technical solution and the inventive concept of the present disclosure. All these modifications and equivalences shall all be covered within the protection claimed in the claims of the present disclosure.

What is claimed is:

1. An antenna assembly, comprising:

an excitation source, configured to generate an excitation signal;

an antenna radiator, comprising a first end and an opposing second end, wherein the antenna radiator is configured to generate an electromagnetic signal according to the excitation signal;

a reference ground, disposed corresponding to the antenna radiator and adjacent to the first end, wherein the reference ground comprises a first surface adjacent to the first end and an opposing second surface adjacent to the second end, the reference ground and the antenna radiator define a gap configured to be at least part of a clearance zone;

a support body, arranged on the second surface of the reference ground and extending along a direction from the first end to the second end; and a conductive sheet, coupled to the second end of the antenna radiator and the excitation source and configured to transmit the excitation signal from the excitation source to the antenna radiator, wherein the conductive sheet is arranged on the support body such that the conductive sheet is adjacent to the second end of the antenna radiator.

2. The antenna assembly according to claim 1, further comprising a circuit board stacked on the second surface of the reference ground;

wherein the support body extends from an end of the circuit board adjacent to the antenna radiator.

3. The antenna assembly according to claim 2, wherein the excitation source is arranged on a surface of the circuit board away from the reference ground, the conductive sheet is arranged on a surface of the support body away from the reference ground.

4. The antenna assembly according to claim 1, wherein the conductive sheet is electrically connected to the second end of the antenna radiator in a way of direct feeding.

5. The antenna assembly according to claim 1, wherein the conductive sheet is electrically connected to the second end of the antenna radiator in a way of coupling feeding.

6. The antenna assembly according to claim 5, wherein the antenna radiator comprises an extending portion extending from the second end of the antenna radiator along a direction substantially perpendicular to the direction from the first end to the second end, such that a coupling capacitor is formed between the extending portion and the conductive sheet.

7. The antenna assembly according to claim 6, wherein the extending portion comprises a first main body and a plurality of first branches extending from a surface of the first main body toward the conductive sheet, the plurality of the first branches are spaced apart from each other;

the conductive sheet comprises a second main body and a plurality of second branches extending from a surface of the second main body toward the extending portion, the plurality of second branches are spaced apart from each other;

at least part of each of the plurality of first branches is inserted between two adjacent second branches.

8. The antenna assembly according to claim 6, wherein the antenna radiator further comprises a first end face away from the second end, and a second end face away from the first end;

a surface of the extending portion away from the conductive sheet is flush with the second end face of the antenna radiator.

9. The antenna assembly according to claim 8, wherein the antenna radiator further comprises a side surface connecting the first end face and the second end face;

at least part of the reference ground faces the side surface of the antenna radiator.

10. The antenna assembly according to claim 9, wherein the first surface of the reference ground is flush with the first end face of the antenna radiator.

11. The antenna assembly according to claim 1, further comprising an impedance matching circuit connected to the excitation source and the antenna radiator, and configured to match an output impedance of the excitation source and an input impedance of the antenna radiator.

12. An antenna assembly, comprising:

an excitation source, configured to generate an excitation signal;

an antenna radiator, comprising a first end and an opposing second end, wherein the antenna radiator is configured to generate an electromagnetic signal according to the excitation signal;

a reference ground, disposed corresponding to the antenna radiator and adjacent to the first end and comprising a first surface adjacent to the first end and an opposing second surface adjacent to the second end;

a support body, arranged on the second surface of the reference ground and extending along a direction from the first end to the second end; and a conductive sheet, arranged on the support body such that the conductive sheet is adjacent to the second end of the antenna radiator, wherein the excitation signal from the excitation source is sequentially transmitted to the conductive sheet, the second end of the antenna radiator, the first end of the antenna radiator and the reference ground.

13. The antenna assembly according to claim 12, wherein the antenna radiator further comprises a first end face away from the second end, a second end face away from the first end, and a side surface connecting the first end face and the second end face, the first surface of the reference ground is flush with the first end face of the antenna radiator.

14. The antenna assembly according to claim 12, wherein the conductive sheet is electrically connected to the second end of the antenna radiator in a way of direct feeding.

15. The antenna assembly according to claim 12, wherein the conductive sheet is electrically connected to the second end of the antenna radiator in a way of coupling feeding, wherein the antenna radiator comprises an extending portion extending from the second end of the antenna radiator along a direction substantially perpendicular to the direction from the first end to the second end, such that a coupling capacitor is formed between the extending portion and the conductive sheet.

16. An electronic apparatus, comprising:

a back shell, a front shell, connected to the back shell and comprising an antenna radiator configured to generate electromagnetic signal according to an excitation signal, wherein the antenna radiator comprises a first end away from the back shell and a second end adjacent to the back shell;

a screen, embedded in the front shell, wherein the front shell, the back shell and the screen define a chamber; and an antenna assembly arranged in the chamber and comprising:

an excitation source, configured to generate the excitation signal;

a reference ground, disposed corresponding to the antenna radiator and adjacent to the first end, wherein the reference ground comprises a first surface adjacent to the first end and an opposing second surface adjacent to the second end, the reference ground and the antenna radiator define a gap configured to be at least part of a clearance zone;

a support body, arranged on the second surface of the reference ground and extending along a direction from the first end to the second end; and a conductive sheet, arranged on the support body, coupled to the second end of the antenna radiator and the excitation source and configured to transmit the excitation signal from the excitation source to the antenna radiator.

17. The electronic apparatus according to claim 16, wherein a slot is defined between the antenna radiator and the back shell, a sealing layer is disposed in the slot to connect the antenna radiator and the back shell.

18. The electronic apparatus according to claim 17, wherein the slot is a straight-line slot or a U-shaped slot.

19. The electronic apparatus according to claim 17, further comprising a conductive connector stretching across the slot and connecting the antenna radiator and the back shell.

20. The electronic apparatus according to claim 16, further comprising a conductive connector arranged on the antenna radiator and corresponding to the back shell, such that a capacitive coupling is formed between the second conductive connector and the back shell.

* * * * *